US010583550B2

(12) United States Patent
Lombardi et al.

(10) Patent No.: US 10,583,550 B2
(45) Date of Patent: Mar. 10, 2020

(54) GRIP COMPONENT FOR A HAND TOOL

(71) Applicant: Stanley Black & Decker, Inc., New Britain, CT (US)

(72) Inventors: Keith Lombardi, Avon, CT (US); Aliaksei Chernyshou, Farmington, CT (US); Thomas Pelletier, Wallingford, CT (US); George Soria, Waterbury, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 15/802,283

(22) Filed: Nov. 2, 2017

(65) Prior Publication Data

US 2019/0126459 A1 May 2, 2019

(51) Int. Cl.

| | |
|---|---|
| ***B25G 1/10*** | (2006.01) |
| ***B25G 1/01*** | (2006.01) |
| ***B25G 3/36*** | (2006.01) |

(52) U.S. Cl.

CPC ..... *B25G 1/102* (2013.01); *B25G 1/01* (2013.01); *B25G 3/36* (2013.01)

(58) Field of Classification Search

CPC ..... Y10T 16/466; Y10T 16/476; Y10T 16/48; Y10T 16/498; B25G 1/102; B25G 1/02; B25G 1/01; B25G 1/10; B25G 3/36

See application file for complete search history.

(56) References Cited

U.S. PATENT DOCUMENTS 4,660,832 A * 4/1987 Shomo ..... A63B 49/08 16/431
5,588,343 A * 12/1996 Rust ..... B25G 1/102 81/20
5,740,586 A * 4/1998 Gomas ..... B25G 1/10 16/430

(Continued)

FOREIGN PATENT DOCUMENTS

DE 202006005503 5/2007
DE 202005021195 7/2007

(Continued)

OTHER PUBLICATIONS

Extended European Search Report, Application 18203531.1, dated Mar. 15, 2019.

*Primary Examiner* — Chuck Y Mah
(74) *Attorney, Agent, or Firm* — Medler Ferro Woodhouse & Mills PLLC

(57) ABSTRACT

A hand tool comprising a head portion, a shaft, and a grip component is provided. The shaft is attached to or integral with the head portion, and the grip component is disposed around the shaft. The grip component and the shaft form a handle of the hand tool. The grip component comprises an external portion molded from a first thermoplastic elastomer (TPE) material or thermoplastic urethane (TPU) material, and an inner portion molded from a second TPE material or TPU material. The first TPE or TPU material has a first level of hardness, and the second TPE or TPU material has a lower level of hardness. The inner portion is disposed around the shaft, and the external portion forms a shell around the inner portion and is an exposed user contact surface. The grip component is attached to the shaft via at least a mechanical fastener.

10 Claims, 15 Drawing Sheets

(56) References Cited

U.S. PATENT DOCUMENTS

| | | | | |
|---|---|---|---|---|
| 5,926,911 | A * | 7/1999 | Chen | B25G 1/01 16/111.1 |
| 6,202,511 | B1 * | 3/2001 | Murray | B25G 1/01 81/20 |
| 6,311,369 | B1 * | 11/2001 | Ryu | B25G 1/01 16/430 |
| 6,370,986 | B1 * | 4/2002 | Scott | B25G 1/01 29/428 |
| 6,619,408 | B1 | 9/2003 | Lai | |
| 6,763,747 | B1 | 7/2004 | Gierer et al. | |
| 7,877,843 | B2 | 2/2011 | Holland-Letz | |
| 8,499,665 | B2 * | 8/2013 | St. John | B25D 1/045 81/22 |
| 8,814,719 | B2 * | 8/2014 | Wall, Jr. | A63B 60/22 473/300 |
| 9,168,648 | B2 | 10/2015 | Lombardi | |
| 2004/0058759 | A1 * | 3/2004 | Falone | B25G 1/01 473/568 |
| 2004/0224786 | A1 | 11/2004 | Reardon | |
| 2008/0176670 | A1 * | 7/2008 | Gill | A63B 60/00 473/300 |
| 2008/0263829 | A1 * | 10/2008 | Diasio | A01K 87/08 16/421 |
| 2012/0222525 | A1 * | 9/2012 | Qiu | B25G 1/01 81/489 |

FOREIGN PATENT DOCUMENTS

| | | |
|---|---|---|
| DE | 202007003351 | 8/2007 |
| DE | 102007010972 | 9/2007 |
| DE | 102005055981 | 1/2008 |
| DE | 102006038636 | 1/2008 |
| DE | 202006015466 | 2/2008 |
| DE | 102006037688 | 3/2008 |
| DE | 1020060444506 | 4/2008 |
| EP | 1923194 | 11/2007 |
| EP | 1979135 | 10/2008 |
| WO | 2007048555 | 5/2007 |
| WO | 2007079979 | 5/2007 |
| WO | 2007079787 | 7/2007 |

* cited by examiner

GRIP COMPONENT FOR A HAND TOOL

FIELD OF THE INVENTION

The present application relates to a grip component for a hand tool, and more specifically to a reverse-molded grip component in which an external portion of the grip component is molded before an inner portion of the grip component is molded.

DESCRIPTION OF THE RELATED ART

The present application relates to a hand tool used to strike another object, such as a hammer used to drive a nail. Such a hand tool may be used in construction, manufacturing, and many other applications. The hand tool may include a head portion and a handle attached to or integral with the head portion. The head portion may be made of steel and have a strike surface used to deliver an impact to the nail or other object. The hand tool may be gripped by the handle, which may be formed from wood, from a combination of steel and plastic, or from another material.

SUMMARY

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

One aspect of the embodiments herein relate to a method of forming a grip component for a handle of a hand tool, the method comprising forming an external portion of the grip component by molding a first thermoplastic elastomer (TPE) material or thermoplastic urethane (TPU) material into a shell that surrounds a first cavity, wherein an external surface of the external portion is an exposed user contact surface for the grip component. The method further comprises, after forming the external portion of the grip component, forming an inner portion of the grip component by filling the first cavity with a second TPE material or TPU material, wherein the second TPE material or TPU material is molded to have a second cavity for receiving a shaft of the hand tool, and wherein the first TPE material or TPU material has a first level of hardness and wherein the second TPE or TPU material has a second level of hardness that is lower than the first level of hardness.

In an embodiment, the method further comprises forming the handle of the hand tool by: sliding the grip component onto the shaft via the second cavity in the grip component, and attaching the grip component to the shaft via at least a mechanical fastener In an embodiment, when the grip component is slid onto the shaft, the inner portion of the grip component and the shaft have no adhesive therebetween.

In an embodiment, when the grip component is slid onto the shaft, the inner portion of the grip component and the shaft have only an adhesive with a lap shear strength of less than or equal to 500 therebetween.

In an embodiment, the above adhesive is in a liquid form or a gel form (or otherwise uncured form) when the grip component is being slid onto the shaft.

In an embodiment, the mechanical fastener includes an endcap adapted to be pressed against an end of the grip component, and includes at least one of a screw, nut, and rivet adapted to attach the endcap to the shaft.

In an embodiment, the end of the shaft forms a threaded portion that protrudes from the grip component after the grip component is slid onto the shaft, and the threaded portion is adapted to be attached to the nut or to the screw.

In an embodiment, the grip component is attached to the shaft without compressing of the grip component around the shaft in a radially inward direction.

In an embodiment, the grip component is formed via injection molding of the first TPE or TPU material to form a first layer and injection molding of the second TPE or TPU material to form a second layer in contact with and chemically or mechanically bonded to the first layer, wherein the grip component is formed with only the first layer and the second layer, such that the grip component is a two-layer grip component.

In an embodiment, the second TPE material or TPU material has a durometer that is less than or equal to shore A-40.

In an embodiment, the second TPE material or TPU material has a durometer that is less than or equal to shore A-30.

In an embodiment, the second TPE material or TPU material has a durometer that is less than or equal to shore A-20.

In an embodiment, the second TPE material or TPU material has a durometer that is in a range of between shore A-20 and shore A-30.

In an embodiment, the second TPE material or TPU material has a durometer that is between shore 00-10 and shore 00-30.

In an embodiment, the second TPE material or TPU material has a durometer that is substantially shore 00-20.

In an embodiment, the thickness of the inner portion is at least twice that of the external portion.

In an embodiment, the thickness of the inner portion is less than half that of the external portion.

In an embodiment, a portion of the shaft onto which the grip component is slid has a curved shape.

In an embodiment, when the grip component has not been slid onto the shaft, the second cavity has a substantially straight shape, and a portion of the shaft onto which the grip component is to be slid has a curved shape.

In an embodiment, after the handle is formed, the external portion forms an entire external surface of the grip component, such that none of the second TPE or TPU material of the inner portion is exposed at a side of the grip component.

One aspect of the embodiments herein relates to a hand tool comprising a head portion, a shaft, and a grip component. The head portion is disposed at a first end of the hand tool. The shaft is attached to or integral with the head portion and extending toward a second and opposite end of the hand tool. The grip component is disposed around the shaft at the second end of the hand tool, wherein the grip component and the shaft form a handle of the hand tool. The grip component comprises an external portion molded from a first thermoplastic elastomer (TPE) material or thermoplastic urethane (TPU) material, and an inner portion molded from a second TPE material or TPU material, wherein the first TPE or TPU material has a first level of hardness, and the second TPE or TPU material has a second level of hardness lower than the first level of hardness. The inner portion of the grip component is disposed around the shaft, and the external portion of the grip component forms a shell around the inner portion and is an exposed user contact surface for the grip component. The grip component is attached to the shaft via at least a mechanical fastener.

In an embodiment, the hand tool is a hammer, and the head portion is a hammer head.

In an embodiment, the mechanical fastener includes an endcap adapted to be pressed against an end of the grip component, and includes at least one of a screw, nut, and rivet adapted to attach the endcap to the shaft.

In an embodiment, the inner portion of the grip component and the shaft have no adhesive therebetween.

In an embodiment, the inner portion of the grip component and the shaft have only an adhesive with a lap shear strength of less than or equal to 500 therebetween.

In an embodiment, the end of the shaft forms a threaded portion that protrudes from the grip component, and the threaded portion is adapted to be attached to the nut or to the screw.

In an embodiment, the grip component is formed with only the external portion and the inner portion, such that the grip component is a two-layer grip, wherein the external portion is formed via injection molding of the first TPE or TPU material into a first layer, and the inner portion is formed via injection molding of the second TPE or TPU material into a second layer chemically or mechanically bonded to the first layer.

In an embodiment, the hand tool further comprises a collar fitted around one end of the grip component, wherein the collar and the endcap are disposed at opposite ends of the grip component.

In an embodiment, at least a portion of the shaft within the inner portion of the grip component has a curved shape.

In an embodiment, the external portion is an injection molded first layer, the inner portion is an injection molded second layer in contact with and chemically or mechanically bonded to the first layer, and the grip component is formed with only the first layer and the second layer, such that the grip component is a two-layer grip component.

These and other aspects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not necessarily to scale.

DETAILED DESCRIPTION

Figure 1A:
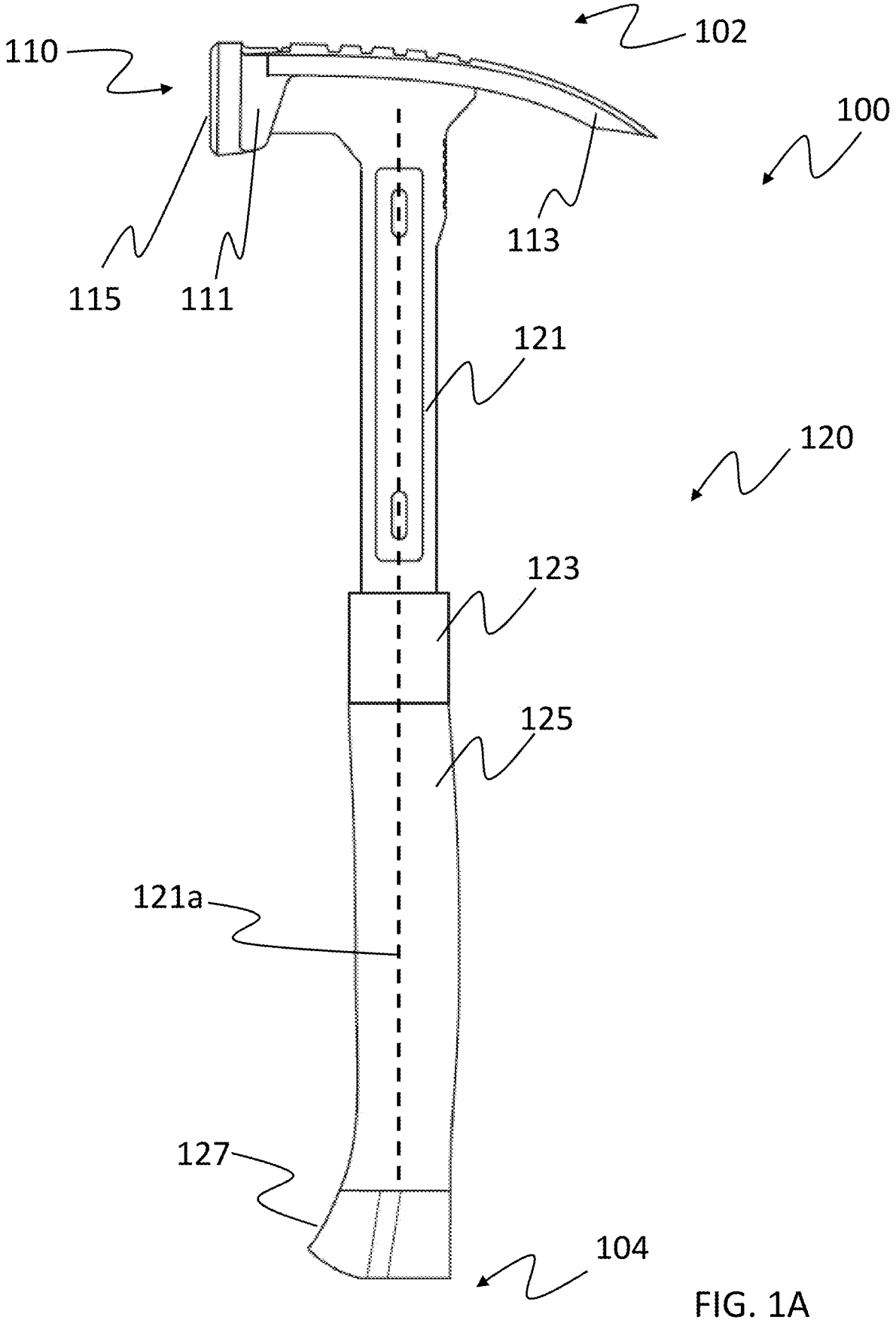
FIG. 1A is a side view of a hand tool, according to an embodiment hereof.

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Embodiments herein relate to a grip component for a handle of a hand tool (e.g., a hammer or hatchet), in which the grip component has at least a molded external portion and a molded inner portion, and in which the molded inner portion is formed after the molded external portion has been formed. Such a grip component may be referred to as a reverse-molded grip component, because the process for making such a grip component may be the reverse of a process in which an inner portion of a grip component is formed before the external portion. In the latter process, a grip component may be formed by injection molding, e.g., a melted first thermoplastic elastomer (TPE) material to form the inner portion, and then, after the inner portion is formed, injection molding a melted second TPE material to flow around the inner portion, wherein the melted second TPE material then cools to form an external portion of the grip component. As the melted second TPE material cools, it may try to contract in an inward direction, and may thus squeeze or otherwise exert pressure on the inner portion. This pressure has the potential to undesirably deform the inner portion, especially if the TPE material of the inner portion is too soft and/or the TPE material of the external portion is harder than that of the inner portion (as measured once the materials have cooled). To avoid being deformed by this pressure, the inner portion for such a process may have a hardness level of at least shore A-40 to resist the pressure of the external portion as the external portion cools from a melted state and tries to contract. This level of hardness for the inner portion may, however, limit its ability to perform vibration isolation or other forms of shock absorption for the hand tool.

Compared to a grip component formed from the process described above, the reverse-molded grip component of embodiments herein may improve vibration isolation and/or simplify assembly of a hand tool. More specifically, embodiments herein relate to a grip component in which, e.g., an external portion is formed first in time by injection molding a first TPE or thermoplastic urethane (TPU) material and allowing the material to cool. The external portion may be formed to have a cavity. After the external portion has been formed, a second TPE or TPU material may be injection molded into the cavity to form the inner portion. This process allows the inner portion to be formed after the first TPE or TPU material of the external portion has already cooled. As a result, the inner portion does not experience, nor need to resist, any contracting pressure from the external portion. Such a condition allows softer materials to be used for the inner portion. For instance, the second TPE or TPU material used in such a reverse molding process may have a hardness level that is less than or equal to shore A-30 or shore A-20, or less than or equal to shore 00-20. The use of the softer material for the inner portion may improve vibration isolation or other forms of shock absorption, which may provide a smoother use of the hand tool and decrease user fatigue.

In an embodiment, the reverse-molded grip component may simplify assembly of a hand tool by being attached to a shaft of the hand tool without the use of an adhesive, or with the use of only a light adhesive (e.g., glue or epoxy) in which the light adhesive may still be uncured when the grip component is being slid onto a shaft. More specifically, the hand tool may have a handle that is formed by sliding the grip component onto a shaft (also referred to as a handle core) of the hand tool, via a cavity surrounded by the inner portion. A more complicated process for attaching the grip component to the shaft for forming the handle may involve applying a pre-adhesive (e.g., an adhesive promoter, such as a primer) to the shaft, then applying a strong adhesive to the shaft, followed by sliding the grip component onto the shaft, and then curing the strong adhesive. In some instances, the process may have to wait for the pre-adhesive to dry before applying the strong adhesive thereon, and before sliding the grip component onto the shaft. Further, while the strong adhesive is being cured in such a process, the grip component may be compressed inwardly by a fixture (e.g., vice grip) along a radial axis of the grip component (i.e., in a radially inward direction). The compression may be used to improve the fit of the shaft within the cavity, and to increase contact between the inner portion of the grip component and the shaft, so as to provide more surface area for the strong adhesive to bond. The above process may, however, increase the time and cost of assembling the hand tool.

The reverse-molded grip component of the embodiments herein may be suitable for eliminating or reducing some of the above steps, because the softer inner portion of the grip component may already provide a good fit of the shaft within the cavity formed by the inner portion, even without compressing the grip component along a radial axis thereof or without the use of a strong adhesive. That is, the soft material of the inner portion may better conform to a shape of the shaft, so as to provide a tight fit around the shaft. As a result, the grip component may rely on a mechanical fastener, rather than a pre-adhesive (e.g., a dried pre-adhesive) and strong adhesive, to attach the grip component to the shaft. Further, the use of the pre-adhesive, the strong adhesive, and the compression of the grip component may create a rigid attachment between the grip component and the shaft. Such a rigid attachment may reduce a vibration isolation capability of the grip component. By eliminating the use of the pre-adhesive, strong adhesive, and/or the compression step, the attachment between the grip component and the shaft may be looser (e.g., more elastic), which may further improve the grip component's vibration isolation capability. In an embodiment, a light adhesive may still be used primarily as a lubricant when the grip component is being slid onto the shaft, though the light adhesive may also help attach the grip component to the shaft. In an embodiment, the light adhesive may be in a liquid or gel form when the grip component is being slid on to the shaft. If the light adhesive were being relied upon as a primary way of attaching the grip component to the shaft, the light adhesive may have to be dried on the shaft before the grip component is slid thereon, in order to achieve a strong bond between the shaft and the grip component. However, because the primary purpose of the light adhesive in the embodiments herein is to provide lubrication rather than to attach the shaft to the grip component, it may be unnecessary to wait for the light adhesive to dry before sliding the grip component onto the shaft. In fact, by sliding the grip component on the shaft while the light adhesive is still in liquid or gel form, the light adhesive may be better able to provide lubrication in such a form. In an embodiment, the light adhesive may have a long work time and/or long dry time so as to better ensure that it stays in the liquid or gel form until the grip component has been slid onto the shaft. In an embodiment, no adhesive other than the light adhesive is between the grip component and the shaft.

Figure 1B:
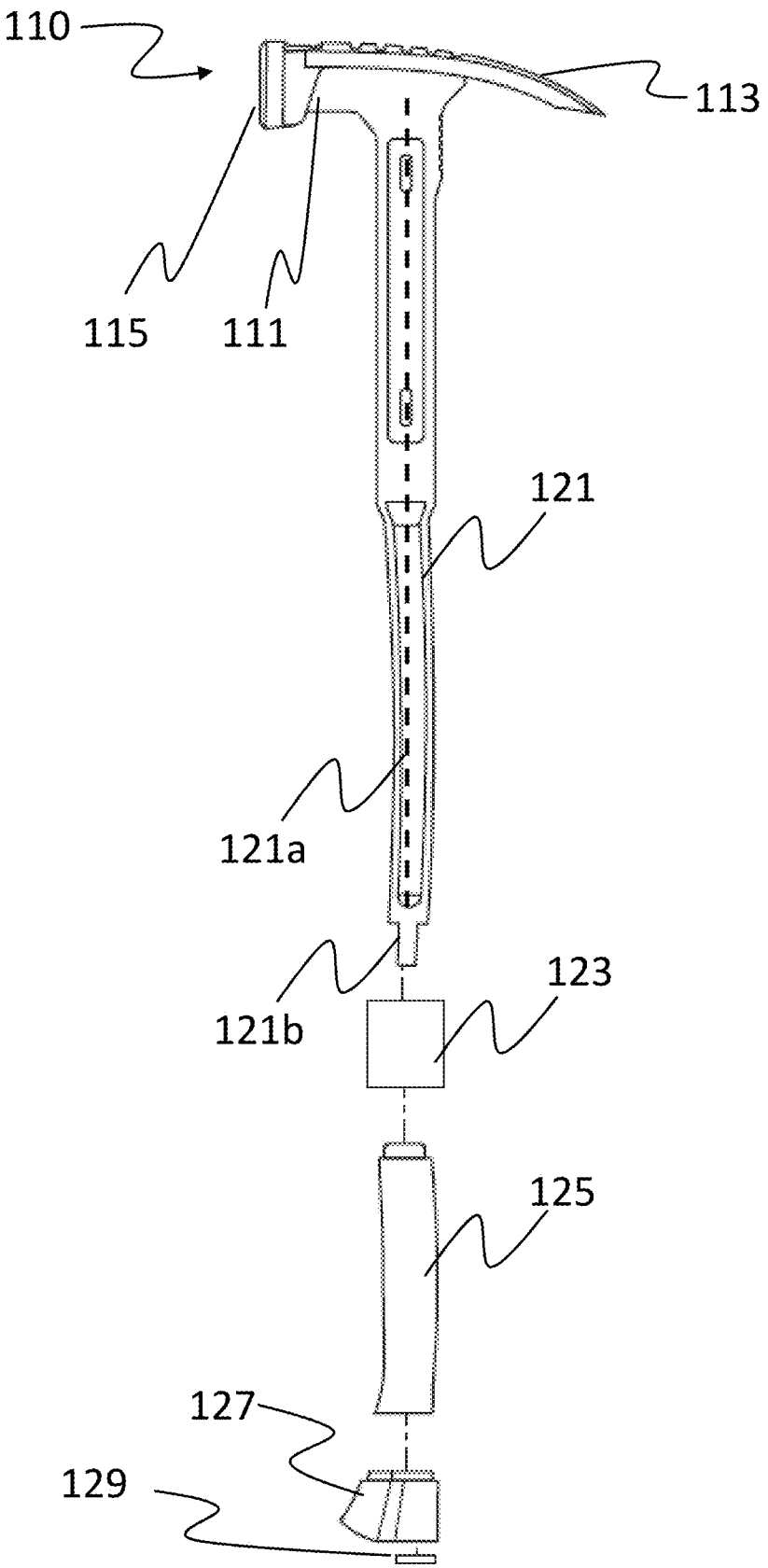
FIG. 1B is an exploded side view of a hand tool, according to an embodiment hereof.

FIGS. 1A and 1B illustrate an embodiment of a hand tool 100 that is a hammer (e.g., a 14 oz. or 32 oz. framing hammer), though other embodiments may involve a hand tool that is a hatchet or other type of hand tool. The hand tool 100 includes a head portion 110 (e.g., a hammer head) and a handle 120. The head portion 110 may be used to strike a nail or other object, and may be located at a first end 102 (e.g., an upper end) of the hand tool 100, while the handle 120 may extend between the head portion 110 and a second, opposite end 104 (e.g., bottom end) of the hand tool 100.

In an embodiment, the head portion 110 may include a bell portion 111 at one end of the head portion 110, and include a claw portion 113 (e.g., a rip-type or claw-type) at the opposite end of the head portion 110. The bell portion 111 may have a strike surface 115 for striking the nail or other object. In an embodiment, the strike surface 115 may have a "waffle" pattern machined into or otherwise formed on the strike surface 115. The structure and the material for the head portion 110 are described in more detail in U.S. Patent Application Publication No. 2014/0001426, entitled "Hammer," to Lombardi et al., the entire content of which is incorporated herein by reference.

Figure 1C:
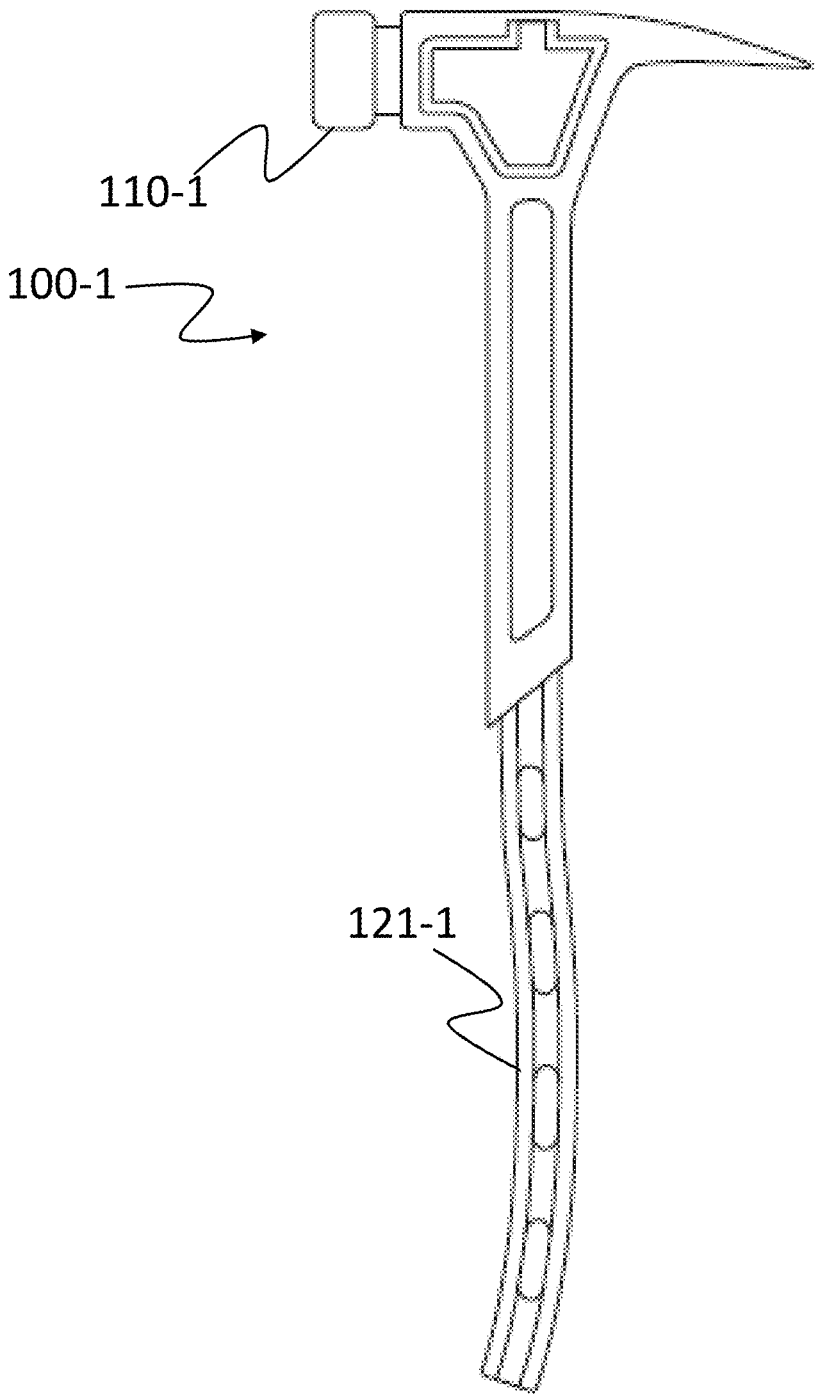
FIG. 1C is a side view of a shaft for a handle of a hand tool, according to an embodiment hereof.

In an embodiment, the handle 120 may include a collar 123, a grip component 125, an endcap 127, and a shaft 121 that extends toward the second end 104 of the hand tool 100. The shaft 121 may be integrally formed with the head portion 110 (so that the shaft 121 and head portion 110 are part of a single piece) or may be formed separately from the head portion 110 and attached thereto (e.g., via a weld connection). The shaft 121 may be formed from, e.g., a steel alloy, and may be referred to as a handle core. The structure and material of the shaft 121 is also described in more detail in U.S. Patent Application Publication No. 2014/0001426, the entire content of which is incorporated herein by reference. The shaft 121 may be elongated in shape, and may be substantially straight along a longitudinal axis 121*a* thereof, or may have a curved shape along the longitudinal axis 121*a*. For instance, FIG. 1C illustrates an embodiment in which a hand tool 100-1 has a shaft 121-1 with a curved shape at an end of the shaft 121-1 that is opposite to a head portion 110-1 of the hand tool 100-1. Returning to FIGS. 1A and 1B, the shaft 121 may, in an embodiment, have a threaded portion 121*b* (FIG. 1B) at an end of the shaft 121, opposite to the head portion 110 of the hand tool 100. This end of the shaft 121 may also be the second end 104 of the hand tool 100. In the embodiment of FIG. 1B, the threaded portion 121*b* may have threads on an external surface thereof, and may be adapted to be attached to the endcap 127 and a nut 129. In another embodiment, the threaded portion 121*b* may be a threaded post that has threads on an inner surface thereof, and may be adapted to be attached to an endcap and a screw. The threaded portion 121*b*, endcap 127, and nut 129 (or screw) provide an example of a mechanical fastener for attaching the shaft 121 to the grip component 125, as discussed in more detail below.

In the embodiment of FIGS. 1A and 1B, the collar 123, grip component 125, and the endcap 127 may be slid onto at least a portion of the shaft 121 to form the handle 120. The sliding of the collar 123, grip component 125, and endcap 127 onto the shaft 121 may entail the collar 123, grip component 125, and/or endcap 127 being moved, or may entail the shaft 121 being moved (e.g., being inserted into the collar 123, grip component 125, and endcap 127). In an embodiment, the collar 123, grip component 125, and endcap 127 may be separate components, as illustrated in FIGS. 1A and 1B. In another embodiment, the grip component 125 may be overmolded on the collar 123 or the endcap 127, so as to form an integral component therewith. For instance, the collar 123 or the endcap 127 may be placed into a mold that forms the grip component 125, so that the grip component 125 is overmolded on the collar 123 or the endcap 127.

Figure 2A:
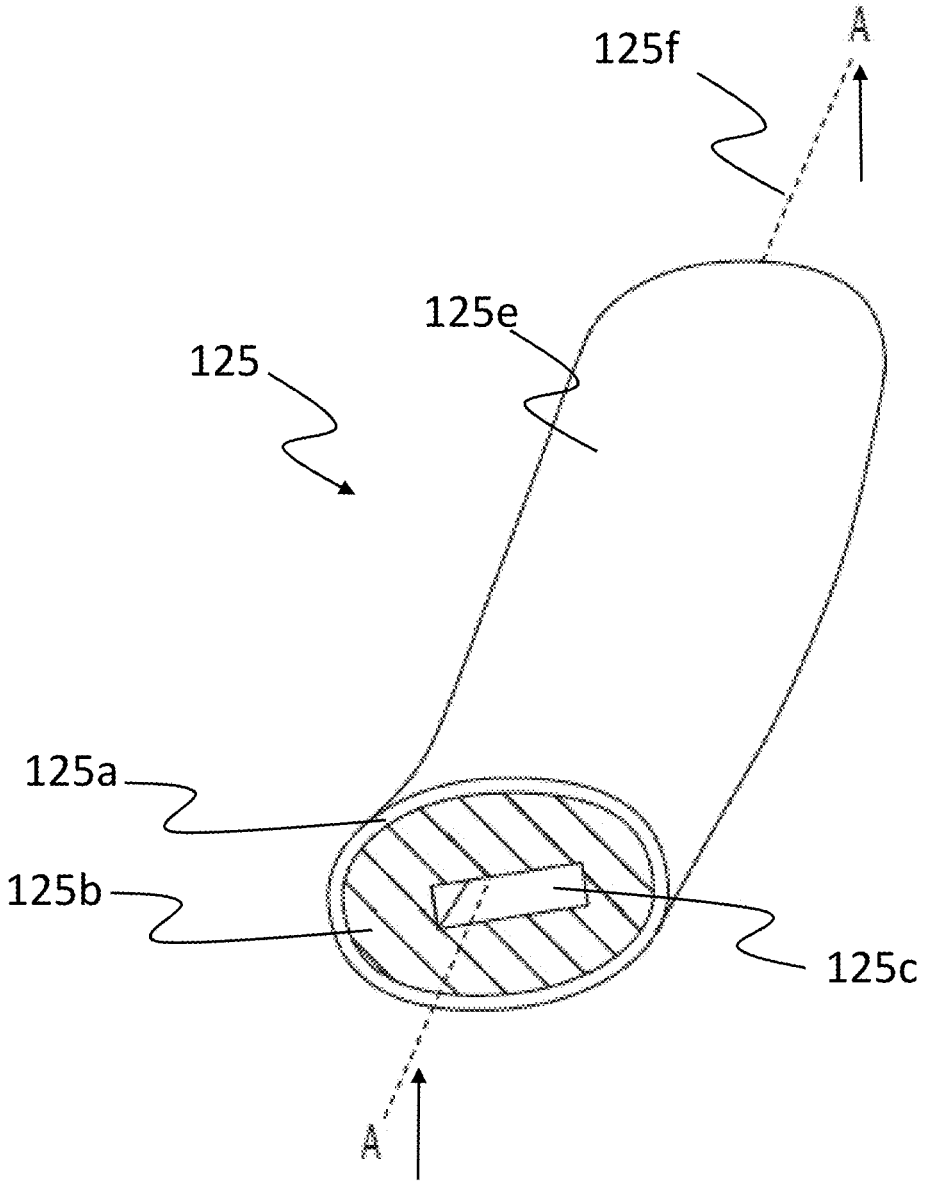
FIG. 2A is a perspective view of a grip component for a handle of a hand tool, according to an embodiment hereof.
Figure 2B:
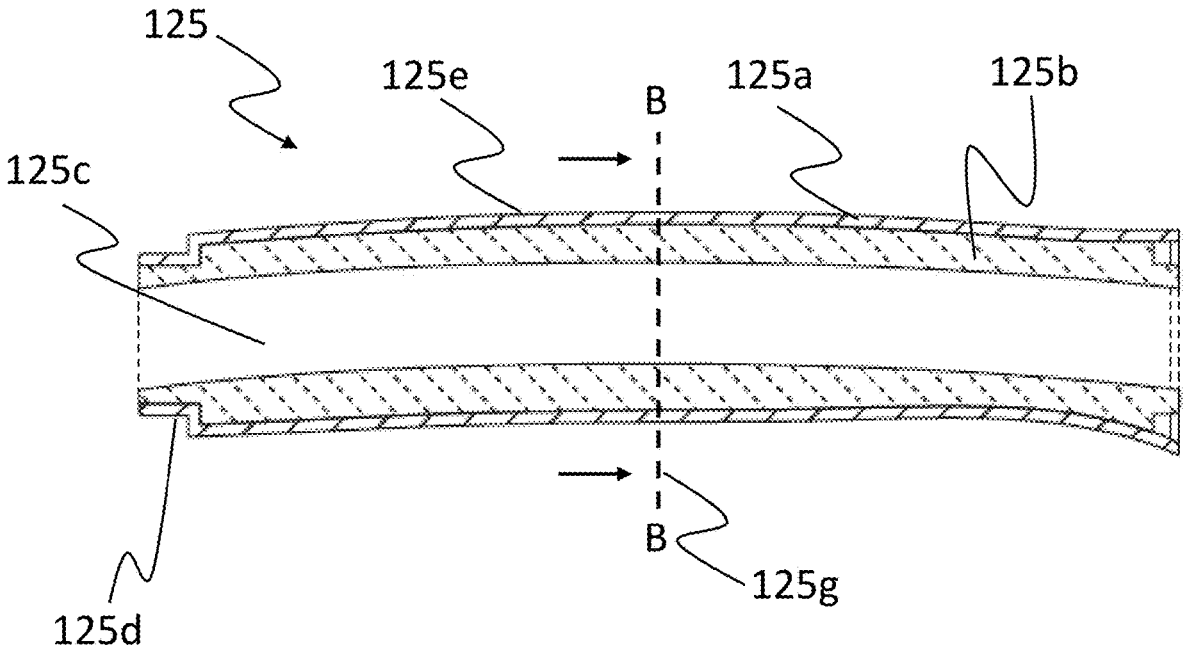
FIG. 2B is a sectional view of a grip component for a handle of a hand tool, according to an embodiment hereof.

FIGS. 2A and 2B illustrate a perspective view and a sectional view, respectively, of an embodiment of the grip component 125 that includes an external portion 125*a* and an inner portion 125*b*. The sectional view of FIG. 2B cuts along the line A-A, which may also be a longitudinal axis 125*f* of the grip component 125, and is a view that is in a direction indicated by the arrows in FIG. 2A. In an embodiment, the external portion 125*a* forms a shell around the inner portion 125*b*. In an embodiment, the external portion 125*a* may form a first layer that is an external layer (also referred to as outer layer) of the grip component 125, and the inner portion 125*b* may form a second layer that is an inner layer of the grip component 125. In an embodiment, the grip component 125 may be a two-layer grip that includes only the first layer (formed by the external portion 125*a*) and the second layer (formed by the inner portion 125*b*). In such an embodiment, the external portion 125*a* provides an exposed user contact surface (e.g., grip surface) for the grip component 125. In other words, in such an embodiment, an external surface 125*e* of the external portion 125*a* is a surface that contacts a user when the handle 120 is being gripped. Further, the first layer formed by the external portion and the second layer formed by the inner portion may be in contact with and chemically or mechanically bonded to each other (if there is only an adhesive between the two portions to chemically bond them, they may still considered to be in contact). In an embodiment, the external portion 125*a* forms an entire external surface of the grip component 125, such that none of the material of the inner portion 125*b* is exposed to an external environment at a side of the grip component 125. For instance, the external portion 125*a* may be free of holes or gaps on its external surface.

In an embodiment, both the external portion 125*a* and the inner portion 125*b* may be formed from a thermoplastic elastomer (TPE) or thermoplastic urethane (TPU) material. The TPE and TPU material may also be referred to as a thermoplastic rubber (TPR) material. In a more specific implementation, the external portion 125*a* may be formed by injection molding a first TPE or TPU material, and the inner portion may then be formed by injection molding a second, different TPE or TPU material inside a cavity formed by the external portion 125*a*, as discussed in more detail below. In an embodiment, the first TPE or TPU material of the external portion 125*a* may have a higher level of hardness (e.g., a durometer in a range of shore A-60 to shore A-70) than that of the inner portion 125*b*. The higher level of hardness may enhance durability of the grip component 125 against external wear. In an embodiment, the first TPE or TPU material for the external portion 125*a* may include an additive material that provides abrasion resistance, a material that provides protection against UV radiation (e.g., a UV stabilizer) or other forms of photodegradation, and/or a material that provides protection against certain chemicals.

In an embodiment, the second TPE or TPU material of the inner portion 125*b* may have a level of hardness that is less than or equal to a durometer of shore A-40 (as measured when the material is not in a melted state). In an embodiment, the second TPE or TPU material may have a level of hardness that is less than or equal to a durometer of shore A-30 or shore A-20. In other examples, the second TPE or TPU material may have a durometer that is in a range of shore A-20 to shore A-30, or a durometer in a range of shore 00-10 to shore 00-30 (e.g., a value of shore 00-20). As discussed above, the low durometer values for the second TPE or TPU material of the inner portion 125*b* may serve to isolate an external surface of the grip component 125 from vibration or other movement of the shaft 121. In an embodiment, the use of a TPE or TPU material for the external portion 125*a* may also contribute to the vibration isolation capability of the grip component 125.

In an embodiment, the inner portion 125*b* may have a greater thickness than that of the external portion 125*a*. For instance, the inner portion 125*b* may be at least twice as thick as the external portion 125*a*. In an embodiment, the inner portion 125*b* may have a lower thickness than that of the external portion 125*a*. For instance, the inner portion 125*b* may be at most half as thick as the external portion 125*a*. The ratio of the thickness of the inner portion 125*b* to that of the external portion 125*a* may be based on a balance between durability provided by the external portion 125*a* and shock absorption provided by the inner portion 125*b*, as well as a balance between the cost of the first TPE or TPU material and the cost of the second TPE or TPU material (and any additives materials thereof).

As illustrated in FIG. 1B and FIG. 2B, the external portion 125*a* may be formed to have a neck portion 125*d*, in which the external portion 125*a* narrows along a radial axis 125*g* (also referred to as a width axis) that is perpendicular to the longitudinal axis 125*f* of the grip component. The neck portion 125*d* may be fitted within a recessed portion of the collar 123, which is discussed below in more detail. In another embodiment, the external portion 125*a* may be overmolded on the collar 123, such that the external portion 125*a* surrounds the collar 123. In such an embodiment, the neck portion 125*d* may be omitted from the grip component 125.

FIG. 2B further illustrates that the inner portion 125*b* may be formed to have a cavity 125*c* for sliding the grip component onto the shaft 121 of the hand tool 100. When the grip component 125 has not yet been slid onto the shaft 121, the cavity 125*c* can have a shape that is substantially straight along the longitudinal axis 125*f* of the grip component 125, or may have a curved shape along the longitudinal axis 125*f*. Further, when the grip component 125 has not yet been slid onto the shaft 121, the cavity 125*c* may have a shape that is substantially the same as at least a portion of the shaft 121. Having the same shape may allow the shaft 121 to more easily pass through the cavity 125*c* during the sliding step, and may facilitate better contact between the inner portion 125*b* and the shaft 121 after the grip component 125 is slid thereon. In other instances, however, when the grip component 125 is not yet slid on the shaft 121, the cavity 125*c* may have a shape that is different than a shape of the shaft 121 (or, more specifically, different than a shape of a portion of the shaft 121 onto which the grip component 125 will be slid). For instance, the shaft 121 may have a portion with a curved shape along a longitudinal axis 121*a* thereof, while the cavity 125*c* of the grip component 125 may be substantially straight along a longitudinal axis 125*f* thereof. Such a shape for the cavity 125*c* may be simpler to achieve. Further, the inner portion 125*b* that surrounds the cavity 125*c* may be sufficiently soft (e.g., with a durometer of shore A-20) to accommodate the shaft 121, even if the shaft 121 has a curved shape. For instance, after the grip component 125 is slid onto the shaft 121, the second TPE or TPU material of the inner portion 125*b* may be sufficiently soft such that it conforms to the shape of the shaft 121, so as to provide a fit around the shaft 121. As also discussed in more detail below, the handle 120 may be formed while using only a light adhesive between the shaft 121 and the inner portion 125*b*, or without the use of any adhesive. If the light adhesive is used, it may remain uncured (e.g., in a liquid form or gel form) during formation of the handle 120.

Figure 3A:
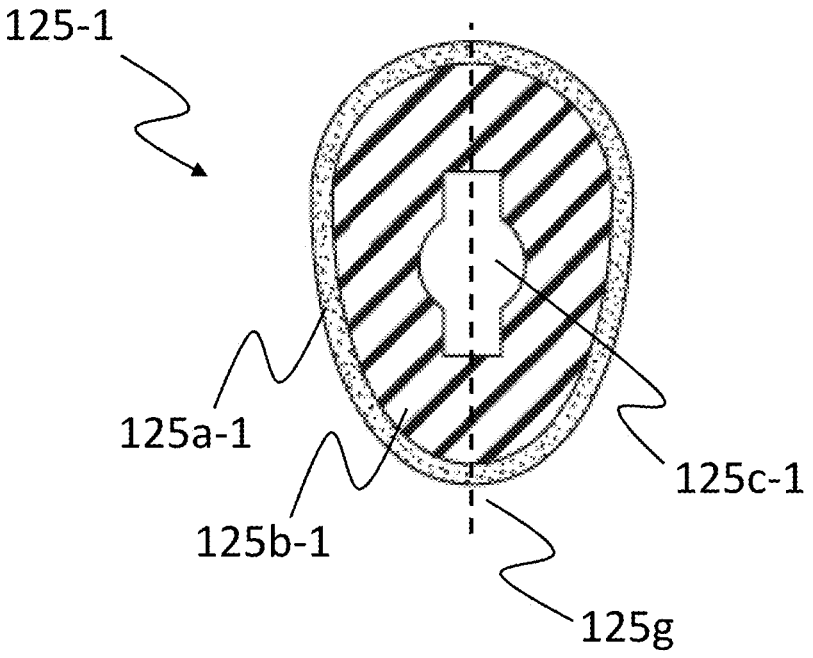
FIGS. 3A and 3B are sectional views of grip components for a handle of a hand tool, according to an embodiment hereof.
Figure 3B:
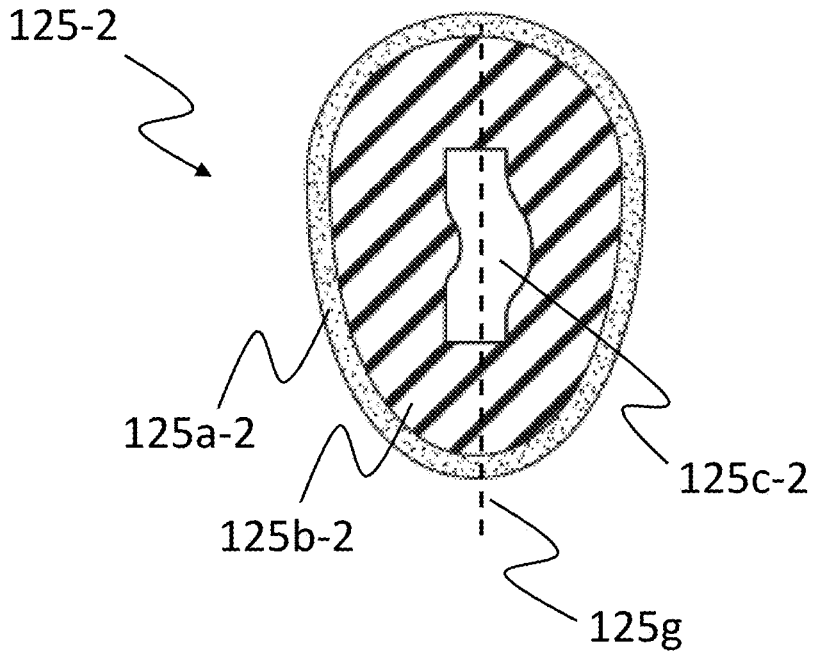

In an embodiment, the cavity 125*c* may have a shape, as viewed from a cross section that cuts along the line B-B (which may be the radial axis 125*g* of the grip component 125), that is rectangular. In other words, the cavity 125*c* may have a rectangular cross section along the radial axis 125*g* of the grip component 125. FIGS. 3A and 3B illustrate other shapes for the cross section of such a cavity. More specifically, FIG. 3A illustrates a cavity 125*c*-1 for a grip component 125-1 whose cross-section, cutting along the line B-B and in the direction indicated by the arrows in FIG. 2B, has a shape that curves outward in two opposite directions, and may be symmetrical with respect to the axis 125*g*. FIG. 3B illustrates a cavity 125*c*-2 for a grip component 125-2 whose cross section, cutting along the line B-B, has a shape that curves in only one direction, such that it is asymmetrical with respect to axis 125*g*. In other words, the cavities 125*c*-1 and 125*c*-2 may have curved cross sections along a radial axis of the respective grip component 125-1, 125-2. In an embodiment, the grip components 125-1 and 125-2 of FIGS. 3A and 3B may be slid onto respective shafts with substantially the same cross sectional shapes, as discussed in more detail below, such as in the discussion of FIG. 7A.

Figure 4:
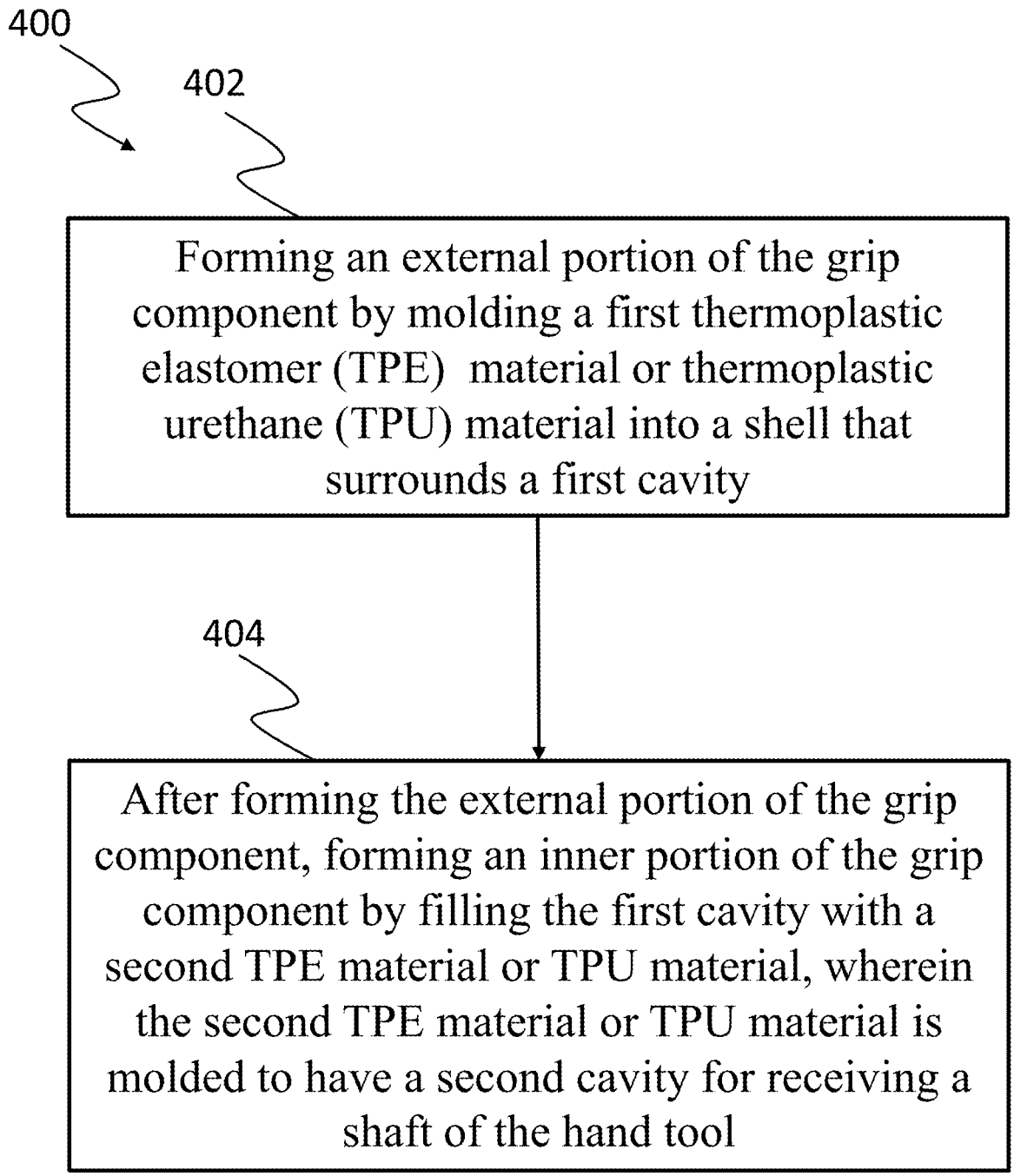
FIG. 4 provides a flow diagram that illustrates example steps of a method for making a grip component for a handle of a hand tool, according to an embodiment hereof.

FIG. 4 illustrates an example method 400 for forming the grip component 125 of the hand tool 100. Generally speaking, the method 400 involves a reverse molding technique in which the external portion 125*a* is formed before the inner portion 125*b* is formed. As discussed above, the reverse molding technique may allow the inner portion 125*b* to have greater softness compared with other manufacturing techniques, while limiting the risk of undesirable deformation to the inner portion 125*b*. The soft inner portion 125*b* may improve vibration isolation for the grip component 125, and may simplify assembly of the hand tool 100.

Figure 5A:
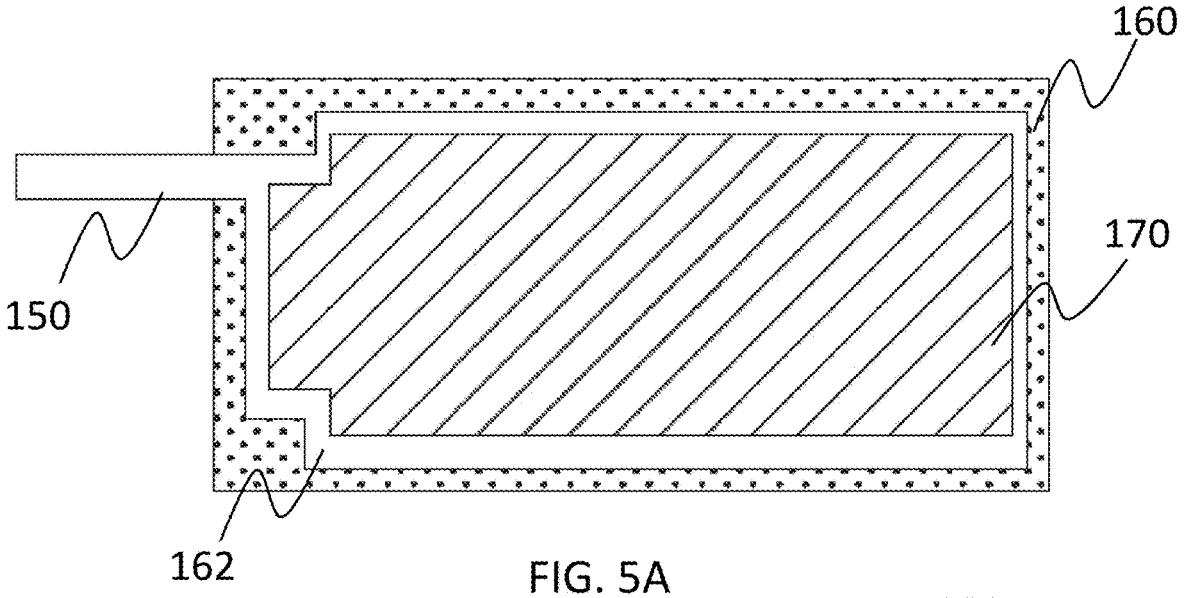
FIG. 5A illustrates a mold for injection molding of an external portion of a grip component, according to an embodiment hereof.
Figure 5B:
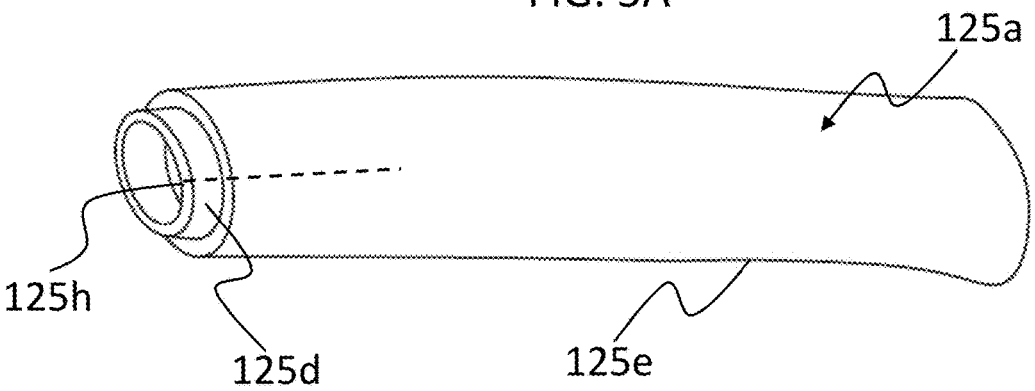
FIG. 5B is a perspective view of an external portion of a grip component, according to an embodiment hereof.
Figure 5C:
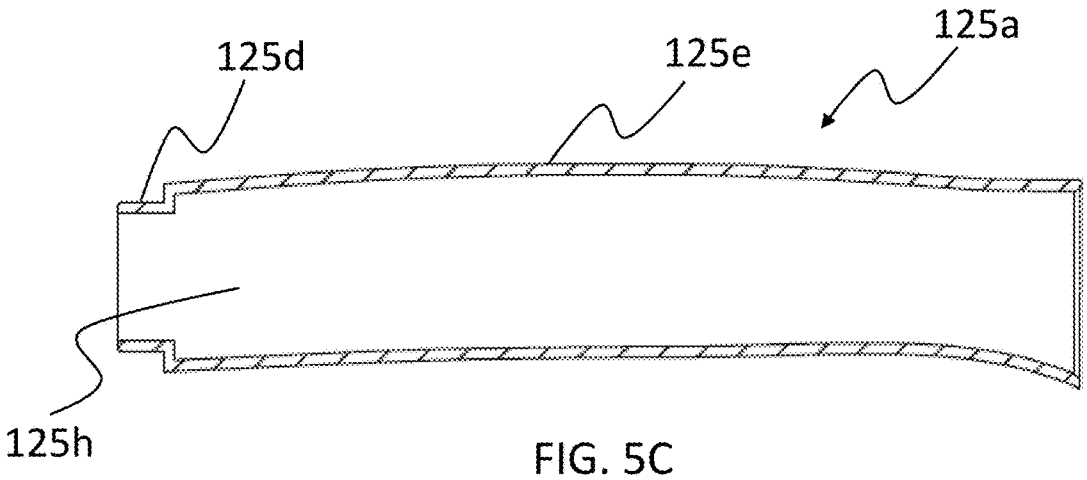
FIG. 5C is a sectional view of an external portion of a grip component, according to an embodiment hereof.

In an embodiment, the method 400 begins at step 402, in which the external portion 125*a* of the grip component 125 is formed by molding a first thermoplastic elastomer (TPE) or thermoplastic urethane (TPU) material into a shell that surrounds a first cavity. For instance, FIG. 5A illustrates an example of step 402, in which the external portion 125*a* of the grip component 125 is formed by injection molding the first TPE or TPU material into a mold 160. In a more specific example, a single shot of the first TPE or TPU material may be melted and forced into the mold 160 through an inlet 150 (e.g., a runner or sprue). The mold 160 may include a mold core 170 around which the melted first TPE or TPU material flows to form a shell that surrounds a cavity, such as the first cavity 125*h*, which is illustrated in FIG. 5B. The shape and thickness of the shell may be defined by a mold cavity 162 between the mold core 170 and an inner surface of the mold 160. In the example of FIGS. 5A-5C, the mold cavity 162 between mold core 170 and the inner surface of the mold 160 may have a shape that causes the external portion 125*a* to have the neck portion 125*d*. The neck portion 125*d* may be fitted into the collar 123, as discussed below. In another embodiment, the collar 123 or endcap 127 may be placed in the core 160, such that the melted first TPE or TPU material flows around the collar 123 or endcap 127, and the external portion 125*a* is overmolded on the collar 123 or on the endcap 127 of FIGS. 1A and 1B. In an embodiment, the external surface 125*e* of the external portion 125*a* is an exposed user contact surface (e.g., a grip surface) for the grip component 125.

Figure 6A:
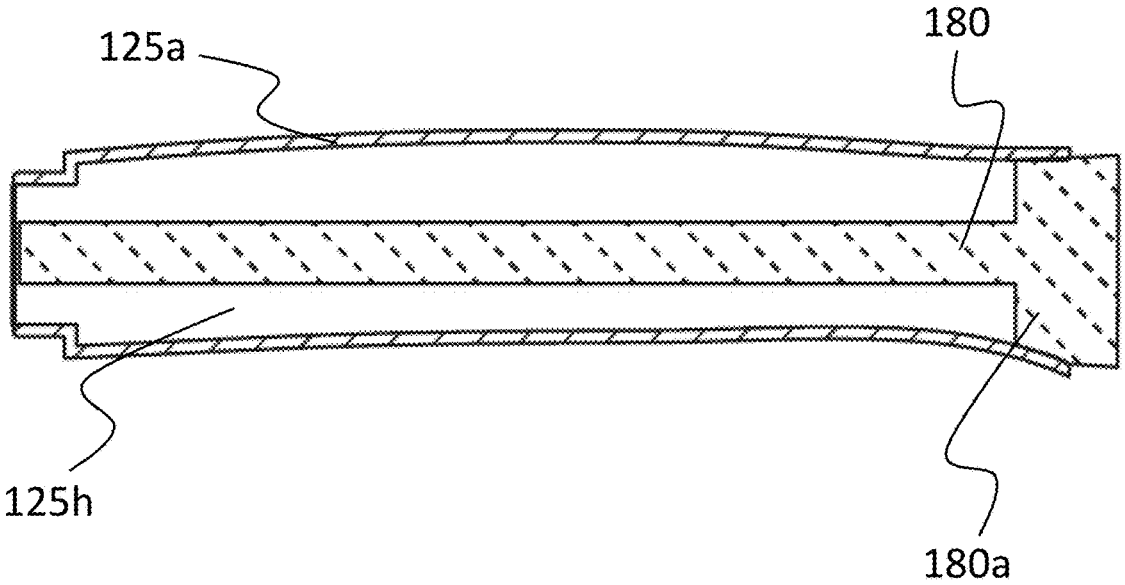
FIG. 6A illustrates a mold core for injection molding of an inner portion of a grip component within a cavity formed by the external portion of the grip component, according to an embodiment hereof.

Returning to FIG. 4, the method 400 further includes a step 404 that is performed after step 402. In some instances, step 404 is performed after the first TPE or TPU material has cooled to a solid form. In step 404, the inner portion 125*b* of the grip component 125 is formed by filling a portion of the first cavity 125*h* with a second TPE or TPU material. The second TPE or TPU material may be molded to have a second cavity that is the cavity 125*c*, which may be used to receive the shaft 121. For instance, FIG. 6A illustrates an example of step 404, in which a mold core 180 is placed in the first cavity 125*h*. The core 180 may be may have a shape that is substantially straight so as to form a substantially straight second cavity 125*c*, or may have a curved shape so as to form a curved second cavity 125*c*. In an embodiment, the core 180 may have a shape and size that is substantially the same as at least a portion of the shaft 121 onto which the grip component 125 will be slid. In another embodiment, the core 180 may have a different shape and size than that of the shaft 121. Such a core 180 may cause the second cavity 125*c* to have a different shape than the shaft 121, but the inner portion 125*b* that surrounds the cavity 125*c* may be sufficiently soft to still accommodate the shaft 121, as discussed above.

Figure 6B:
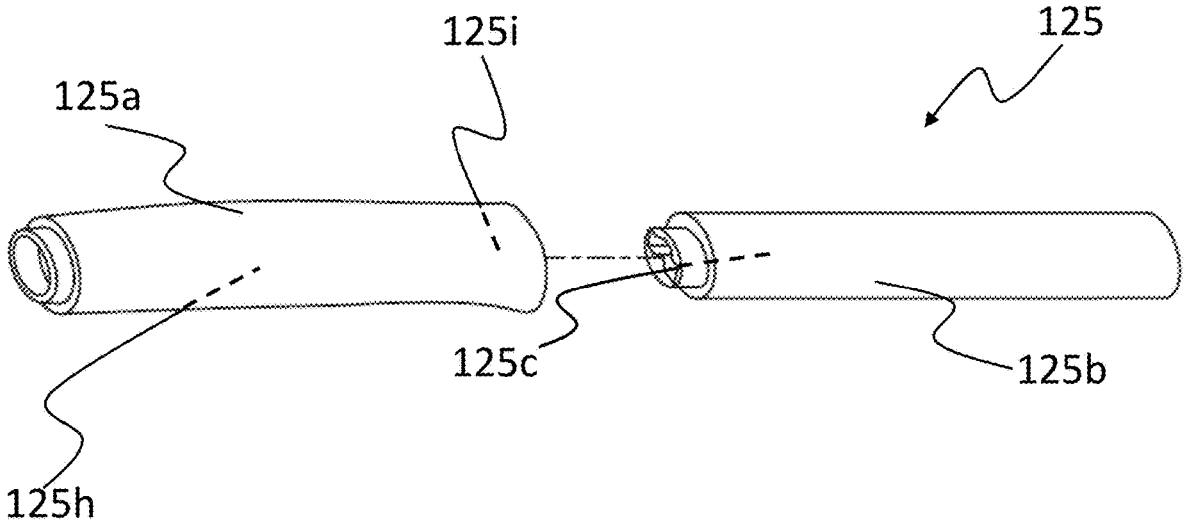
FIG. 6B is an exploded perspective view of an external portion and an inner portion of a grip component, according to an embodiment hereof.

In the example of FIG. 6A, a single shot of the second TPE or TPU material may be melted and injection molded into a portion of the first cavity 125*h*. The melted second TPE or TPU material may fill the portion of the first cavity 125*h* between the core 180 and an inner surface of the external portion 125*a*. After the second TPE or TPU material cools to a solid (or even a gel) form, the core 180 may be removed, leaving the inner portion 125*b* illustrated in FIG. 6B in the first cavity 125*h*. The space previously occupied by the core 180 may become the second cavity 125*c*. In an embodiment, a portion 180*a* the core 180 may occupy a space that will later become a recessed portion 125*i* at an end the grip component 125, the recessed portion 125*i* being between the inner portion 125*b* and an outer edge of the external portion 125*a*. The recessed portion 125*i* may be used to receive a portion of the endcap 127, as discussed below.

In an embodiment, the first TPE or TPU material of the external portion 125*a* may have a first level of hardness, and the second TPE material of the inner portion 125*b* may have a second level of hardness (as measured when the materials have cooled) that is lower than the first level of hardness. In an embodiment, the first TPE or TPU material of the external portion 125*a* and the second TPE or TPU material of the inner portion 125*b* may be chemically bonded (e.g., via an adhesive) of mechanically bonded (e.g., via mechanically interlocking structures formed in the external portion 125*a* and inner portion 125*b*). In an embodiment, such a chemical bond (e.g., adhesive) or mechanical bond may be omitted. In an embodiment, the grip component 125 may be formed with only two shots of two different respective types of TPE or TPU material, wherein material of the later-molded shot may have a minimum softness level (e.g., shore A-30 or less). In an embodiment, the grip component 125 may be formed with more than two shots of different respective TPE or TPU materials, in which the last-molded shot may have a certain softness level.

Figure 7A:
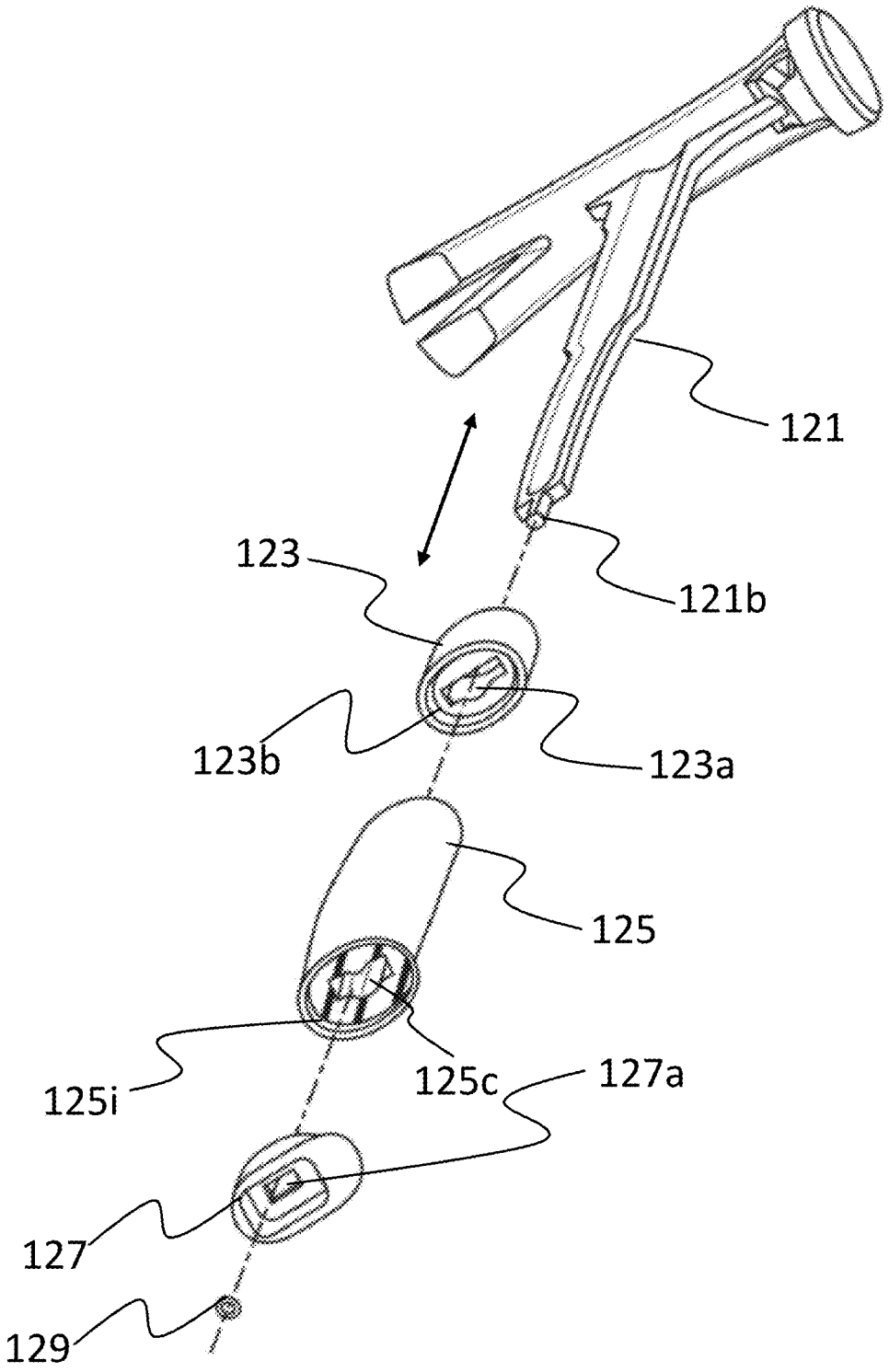
FIG. 7A is an exploded perspective view that illustrates assembly of the components of a handle for a hand tool, according to an embodiment hereof.

In an embodiment, after step 404 is performed to form the grip component 125, a step may be performed to form the handle 120 of the hand tool 100 by sliding the grip component 125 onto the shaft 121 via the second cavity in the grip component. FIG. 7A illustrates the grip component 125 (along with the collar 123 and endcap 127) being slid onto the shaft 121. In an embodiment, no adhesive is applied to shaft 121 or within the cavity 125*c* before the grip component 125 is slid onto the shaft 121. In an embodiment, only a light adhesive is applied to the shaft 121 before the grip component 125 is slid onto the shaft 121. The light adhesive may refer to an adhesive that has relatively weak bonding strength, and may be used primarily as a lubricant to reduce friction between the inner portion 125*b* and the shaft 121 as they slide past each other, rather than used to create a strong bond between the shaft 121 and inner component 125*b*. In an embodiment, the light adhesive may be an adhesive that has a lap shear strength of less than or equal to 500 $lb/in^2$. In an embodiment, the light adhesive may have a long work time and/or dry time, so that the light adhesive is in a liquid or gel form when the grip component 125 is being slid onto the shaft 121. For instance, the light adhesive may have a dry time that is at least 10 minutes. In another example, the light adhesive may have a dry time that is in in a range of one to five days, or four to five days. By being in the liquid or gel form, the light adhesive may lubricate the shaft and/or grip component as they are being slid relative to each other. In other words, because the light adhesive is not intended to create a strong bond between the shaft 121 and inner portion 125*b*, the light adhesive does not need to be cured before or during formation of the handle 120. That is, the grip component 125 may be attached to the shaft 121 without waiting for the light adhesive to cure. In an embodiment, the light adhesive may be a two-component adhesive. Further, as discussed above, the grip component 125 may be attached to the shaft 121 without compressing the grip component 125 around the shaft 121 along the radial axis 125*g* of the grip component 125.

In some instances, the step of forming the handle 120 may further include attaching the grip component 125 to the shaft 121 via at least a mechanical fastener. As discussed above, the use of a mechanical fastener rather than a strong adhesive to attach the grip component 125 to the shaft 121 may contribute to an attachment that is looser (e.g., more elastic), which may improve vibration isolation and other forms of shock absorption. In an embodiment, the mechanical fastener may include the endcap 127 and at least one of a screw, nut, and a rivet. In an embodiment, the mechanical fastener may further include a portion of the shaft 121. For instance, as illustrated in FIG. 7A, the mechanical fastener may include the threaded portion 125*b* of the shaft 121, the endcap 127, and the nut 129. In an embodiment, after the grip component 125 has been slid onto the shaft 121, the threaded portion 121*b* still protrudes from the grip component 125. Then, the endcap 127 may be pressed against an end of the grip component 125, and the threaded portion 121*b* of the shaft 121 may pass through an opening 127*a* of the endcap 127. Then, the nut 129 may be threaded onto the threaded portion 121, so as to attach the endcap 127 to the shaft 121. More specifically, the nut 129 may press against the endcap 127, which in turn presses against the grip component 125 so as to keep the grip component 125 on the shaft 121. In an embodiment, the endcap may be formed from a material (e.g., polypropylene) that has sufficient hardness to bear a pressure being exerted against it by the nut 129. In another embodiment, the external portion 125*a* of the grip component 125 may be overmolded on the endcap 127.

As further illustrated in FIG. 7A, the collar 123 may be slid onto the shaft 121, after which the grip component 125 is slid onto the shaft 121. The collar 123 may form a cavity 123*a* that fits around at least a portion of the shaft 121, and may form a recessed portion 123*b*. As discussed above, the neck portion 125*d* of the external portion 125*a* of the grip component 125 may be fitted into the recessed portion 123*b* of the collar 123. As also discussed above, in other embodiments the external portion 125*a* may be overmolded on the collar 123, or the collar 123 may be omitted from the handle 120.

Figure 7B:
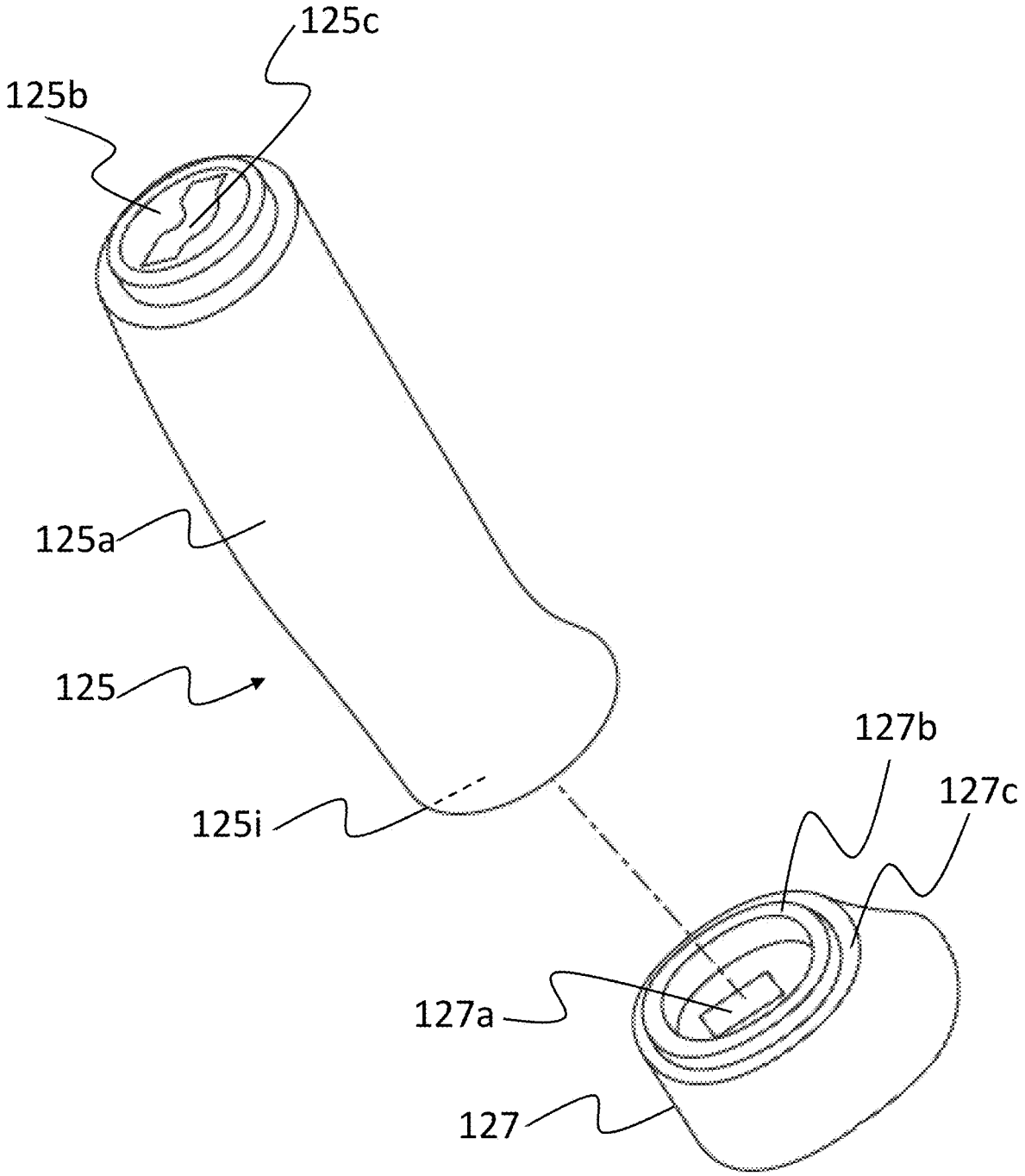
FIG. 7B is an exploded perspective view that illustrates assembly of an endcap with a grip component for a handle of a hand tool, according to an embodiment hereof.

In an embodiment, as illustrated in FIG. 7B, the endcap 127 may have a raised rim 127*b* that fits within a recessed portion 125*i* of the grip component 125. The contour of the raised rim 127*b* may match a profile of the recessed portion 125*i*, such that the recessed portion 125*i* fits around the raised rim 127*b*. In an embodiment, the endcap 127 may have an edge 127*c* with a contour that matches a contour of an edge of the external portion 125*a* of the grip component 125, such that the grip component 125 and the endcap 127 are flush when pressed against each other.

As discussed above, the shaft 121 and the cavity 125*c* may in an embodiment both have a cross section with a curved shape. For instance, the cavity 125*c* of the grip component 125 in FIG. 7A may have the same shape as illustrated in FIG. 3B. In such an example, a cross section of the cavity 125*c*, cutting along a radial axis 125*g* of the grip component 125, may have a curved shape. Further, a cross section of the shaft 121, cutting along a width of the shaft 121, may have the same curved shape as that of the cavity 125*c* or 123*a*.

Figure 8:
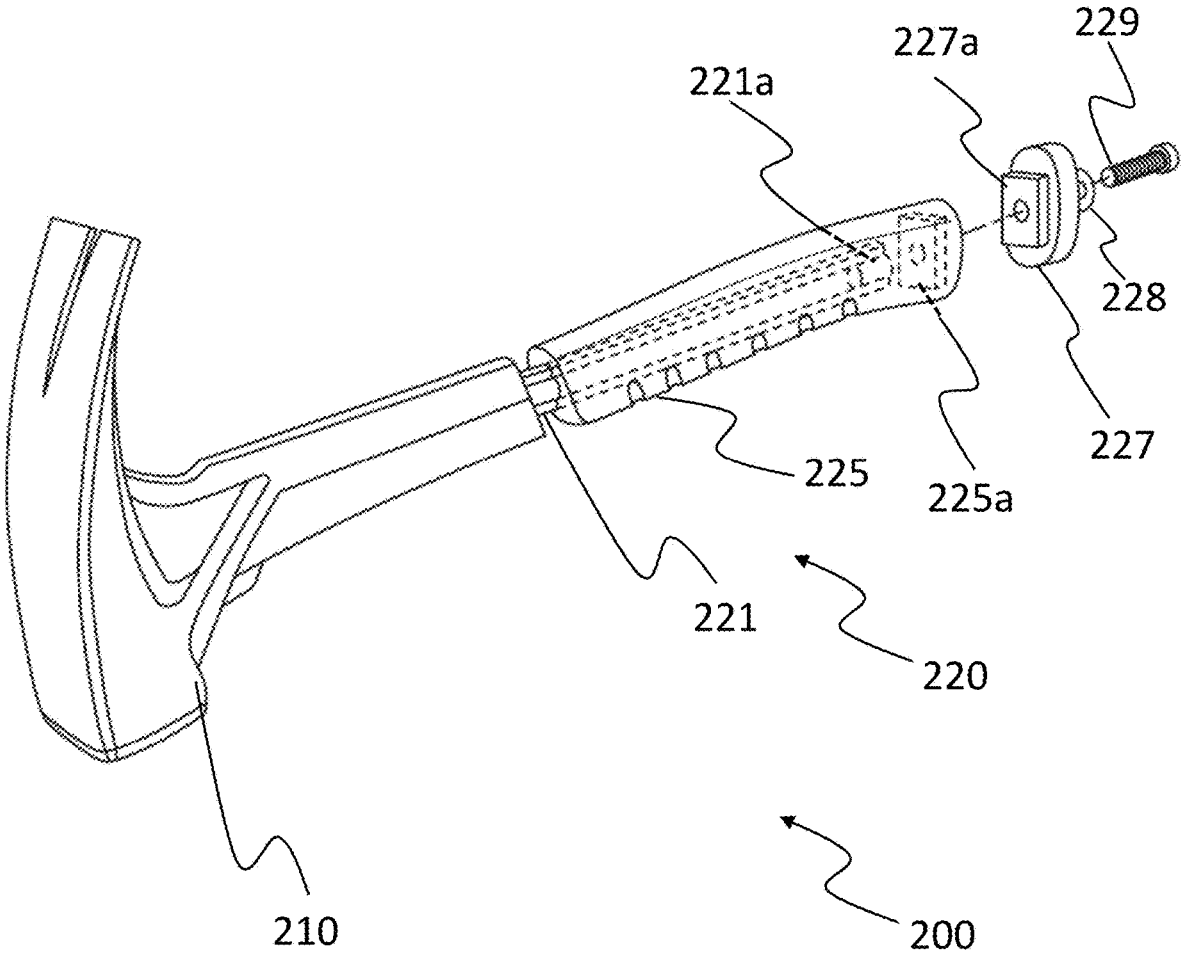
FIG. 8 is a perspective view that illustrates assembly of another embodiment of a hand tool, according to an embodiment hereof.

In another embodiment, as illustrated in FIG. 8, a mechanical fastener used for attaching a grip component to a shaft may include a threaded post, an endcap, and a screw.

More specifically, FIG. 8 illustrates a hand tool 200 having a head portion 210 and a handle 220. The handle 220 is formed by a shaft 221, a grip component 225 that is a reverse-molded grip as described above, and an endcap 227. In the embodiment of FIG. 8, one end of the shaft 221 may form a threaded portion that is a threaded post 221*a*. The threaded post 221*a* may have a cylindrical cavity with threads on an inner surface of the cavity. During assembly of the hand tool 200, the grip component 225 may be slid onto the shaft 221, after which the endcap 227 is pressed against the grip component 225. In an embodiment, the endcap 227 may have a raised portion 227*a* that fits into a recessed portion 225*a* of the grip component 225. After the endcap 227 is pressed against the grip component 225, a screw 229 may be inserted through the endcap 227 and into the grip component 225 as well as into the threaded post 221*a*, so as to attach the endcap 227 to the grip component 225. In this embodiment, the screw 229 may press against the endcap 227 (e.g., via a washer 228), which may in turn press against the grip component 225 to keep the grip component 225 on the shaft 221. In another embodiment, the mechanical fastener may include a rivet (e.g., pop rivet) that attaches the shaft 221 to the grip component 225.

Figure 9A:
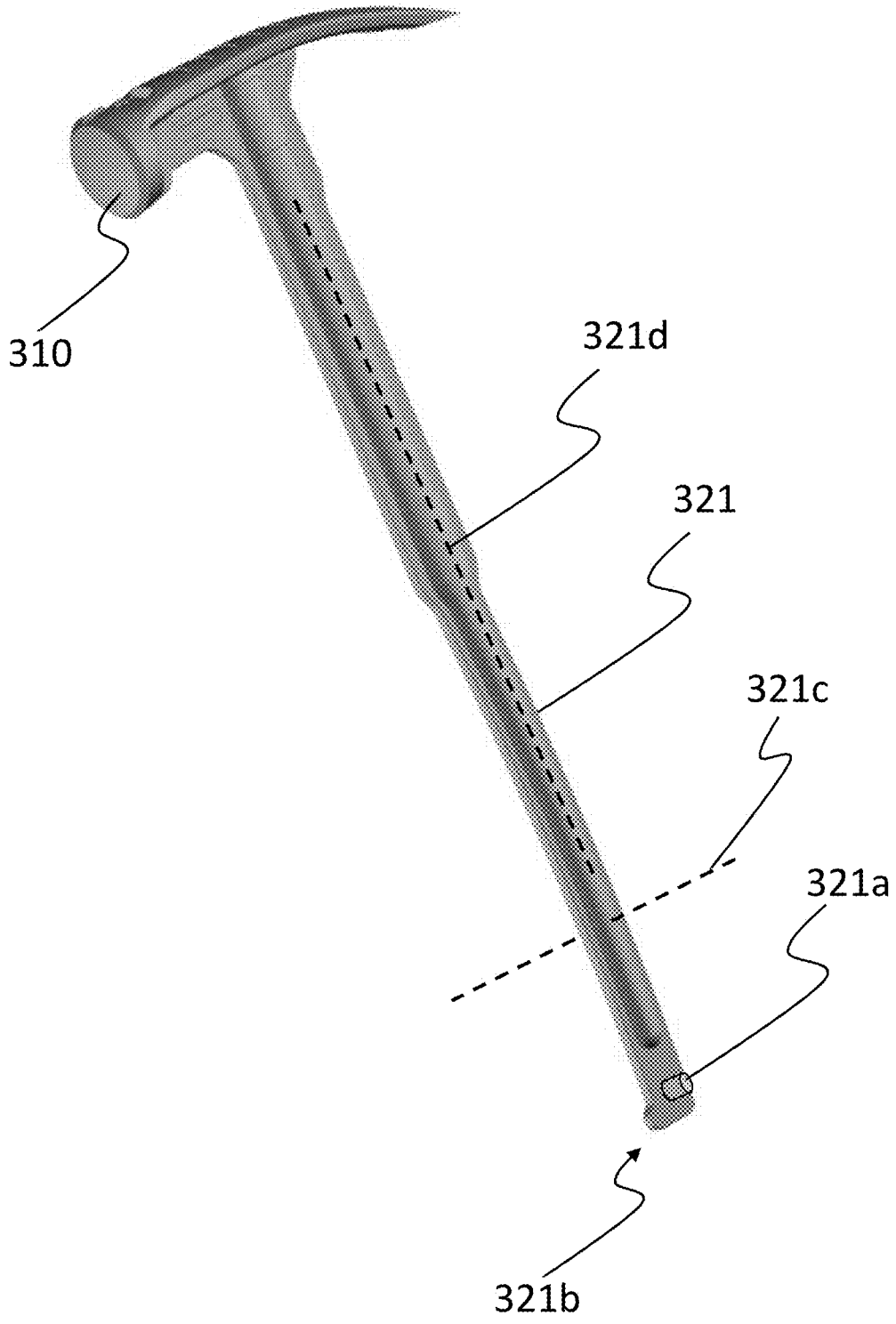
FIGS. 9A and 9B illustrate perspective views of a shaft that has a blind post, according to an embodiment hereof.
Figure 9B:
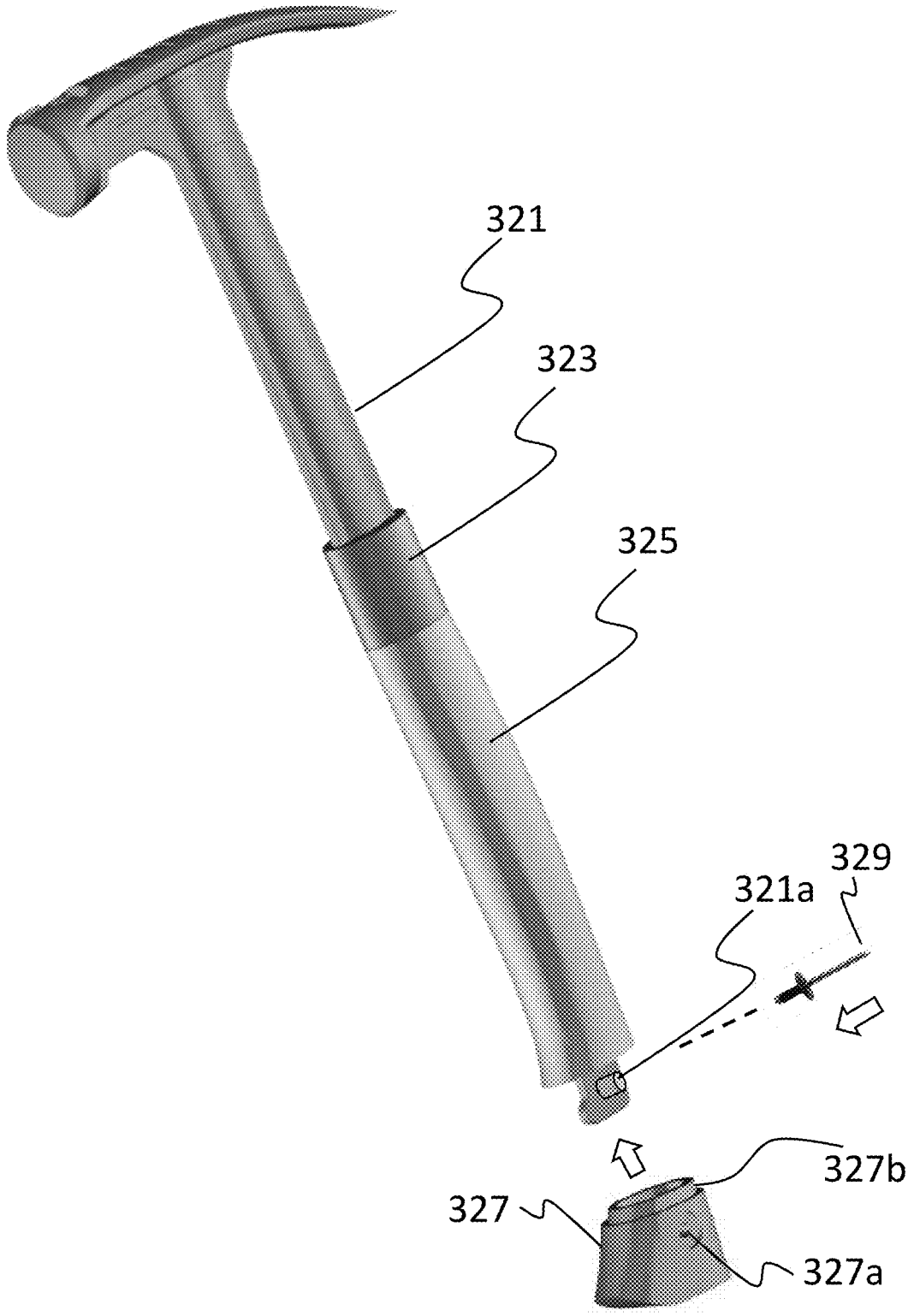

FIGS. 9A and 9B illustrate the use of a rivet 329, a blind post 321*a*, and an endcap 327 to attach a grip component 325 to a shaft 321 of a handle. More specifically, FIG. 9A illustrates a shaft 321 attached to or integral with a head portion 310 of a hand tool. The shaft 321 may have a blind post 321*a* disposed at a second end 321*b* of the shaft 321, opposite to an end of the shaft 321 at which the shaft 321 is connected to or integral with the head portion 310. The blind post 321*a* may extend along a thickness axis 321*c* of the shaft 321. More generally speaking, the blind post 321*a* may extend in a direction perpendicular to a longitudinal axis 321*d* of the shaft 321. The blind post 321*a* has a blind hole therein, wherein the blind hole also extends along the thickness axis 321*c* of the shaft 321. In the embodiment of FIG. 9A, the blind post 321*a* is the only blind post disposed at the second end 321*b* of the shaft 321. In another embodiment, the shaft 321 may have another blind post attached to or integral with the opposite side of the shaft 321 relative to where the blind post 321*a* is attached to or integral with the shaft 321. The other blind post may extend in an opposite direction relative to the blind post 321*a*.

FIG. 9B depicts a collar 323 and a grip component 325 (which has an external portion 325*a* and inner portion 325*b* that are the same or similar to the portions described above) that are slid onto the shaft 321, and illustrates an endcap 327 that may be slid over the second end 321*b* of the shaft 321. The endcap 327 may have a hole 327*a* that will line up with the blind hole of the blind post 321*a* after the endcap 327 has been slid onto the shaft 321. In an embodiment, the hole 327*a* extends from an outer side surface of the endcap through to a cavity within the endcap 327. A rivet 329 may be inserted through the hole 327*a* and into the blind hole of the blind post 321*a* to attach the shaft 321 to the endcap 327, which will press against the grip component 325 to keep the grip component 325 on the shaft 321. The rivet 329 may be, e.g., a solid or barrel-type rivet. In another embodiment, the blind post 321*a* may be threaded, and the rivet 329 may be replaced with a screw. In another embodiment, the blind post 321*a* may be replaced with a first through-hole extending through the shaft 321, and the endcap 327 may have a second through-hole extending through the endcap. In such an embodiment, the endcap 327 may be attached to the shaft 321 with a screw that extends through both through-holes, and with a nut.

Figure 9C:
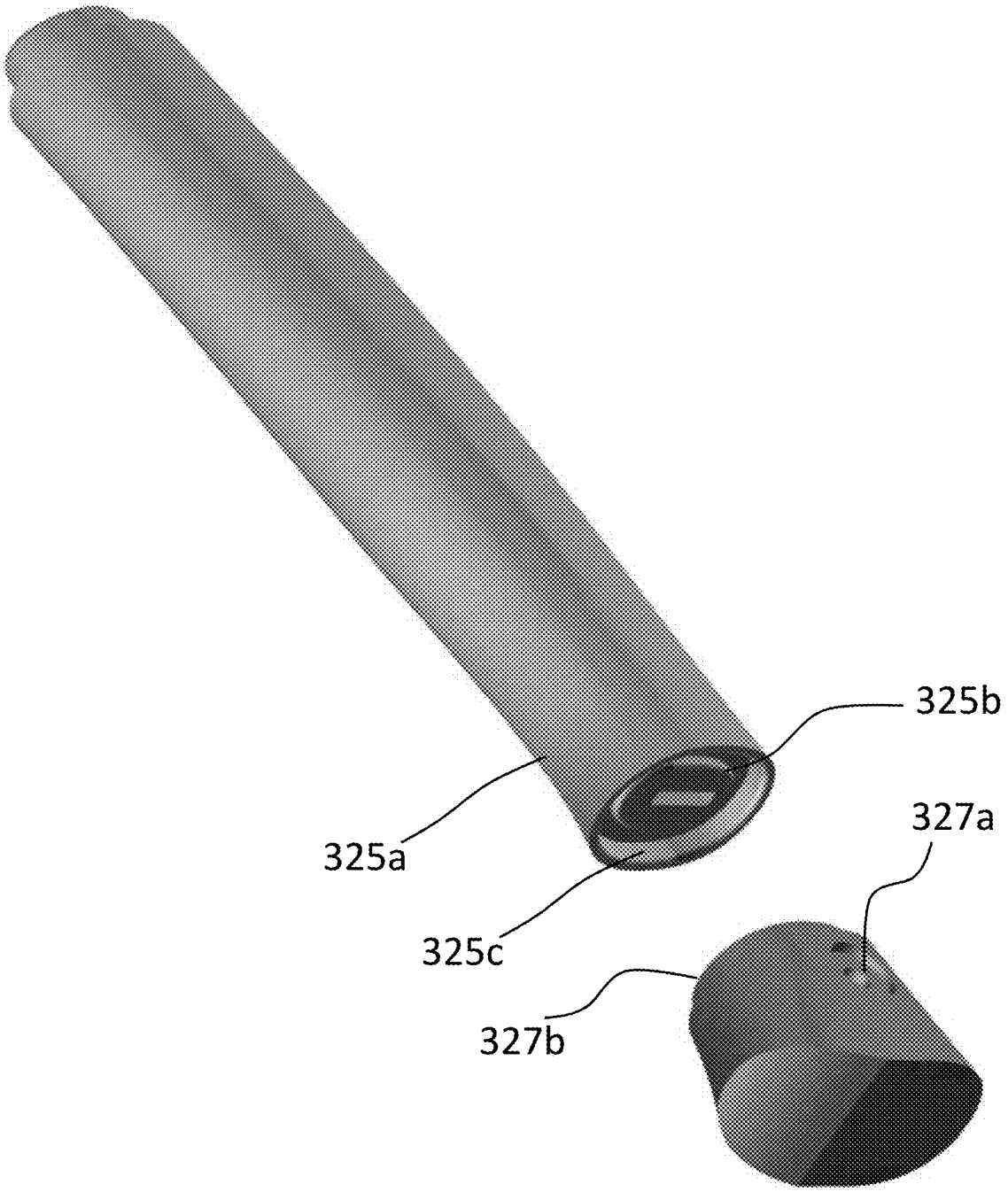
FIG. 9C illustrates a perspective view of a grip component and of an endcap, according to an embodiment hereof.

FIG. 9C provides another view showing the endcap 327 having a raised rim portion 327*b* that can be slid into a recessed portion 325*c* of the grip component 325 so as to press against the grip component 325.

As stated above, embodiments of the reverse-molded grip component as described above may reduce vibration at a user contact surface of the grip component, as compared with vibration at surfaces of other types of grip components. The vibration may be reduced in terms of amplitude, ring rate (i.e., frequency), and ring fade time as compared with other types of grip components. Table 1 illustrates example test results that illustrate the improved vibration isolation:

TABLE 1

| | Max displacement at measuring point | RMS (mm/s) | Ring fade duration | Transfer Function (mm/s/N) |
|---|---|---|---|---|
| Reverse-Molded Grip Component | 1.2 | 56 | 0.054 | 2.29 |
| Other type of Grip Component | 4.0 | 151 | 0.055 | 7.12 |

While various embodiments have been described above, it should be understood that they have been presented only as illustrations and examples of the present invention, and not by way of limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment.

What is claimed is:

1. A hand tool, comprising:

a head portion disposed at a first end of the hand tool;

a shaft attached to or integral with the head portion and extending toward a second and opposite end of the hand tool; and a grip component disposed around the shaft and having an external portion and an inner portion, wherein the grip component and the shaft form a handle of the hand tool; and an endcap in contact with the grip component and forming the second end of the hand tool, wherein the grip component is a reverse-molded component formed by:

forming the external portion of the grip component by molding a first thermoplastic elastomer (TPE) material or thermoplastic urethane (TPU) material into a shell that surrounds a first cavity, and after forming the external portion of the grip component, forming the inner portion of the grip component by injecting a second TPE material or TPU material into the first cavity, wherein the first TPE or TPU material has a first level of hardness, and the second TPE or TPU material has a second level of hardness lower than the first level of hardness, wherein the inner portion of the grip component is disposed around the shaft, and wherein the external portion of the grip component forms the shell around the inner portion and forms an exposed user contact surface for the grip component, and wherein the external portion and the inner portion of the grip component form a recessed portion of the grip component that fits around a portion of the endcap.

2. The hand tool of claim 1, wherein the inner portion of the grip component and the shaft have no adhesive therebetween.

3. The hand tool of claim 1, wherein the inner portion of the grip component and the shaft have only an adhesive with a lap shear strength of less than or equal to 500 $lb/in^2$ therebetween.

4. The hand tool of claim 1, wherein the grip component is mechanically fastened to the shaft via the endcap.

5. The hand tool of claim 1, wherein the second TPE material or TPU material has a durometer that is less than or equal to shore A-30.

6. The hand tool of claim 1, wherein the external portion is an injection molded first layer, the inner portion is an injection molded second layer in contact with and chemically or mechanically bonded to the first layer, and wherein the grip component is formed with only the first layer and the second layer, such that the grip component is a two-layer grip component.

7. The hand tool of claim 1, wherein a thickness of the inner portion is greater than a thickness of the external portion.

8. The hand tool of claim 1, wherein the external portion of the grip component is overmolded on at least one portion of the endcap.

9. The hand tool of claim 1, further comprising a collar fitted around the shaft and disposed at one end of the grip component, wherein the endcap and the collar are disposed at opposite ends of the grip component.

10. A hand tool, comprising:

a head portion disposed at a first end of the hand tool;

a shaft attached to or integral with the head portion and extending toward a second and opposite end of the hand tool;

a grip component disposed around the shaft and having an external portion and an inner portion, wherein the grip component and the shaft form a handle of the hand tool; and an endcap in contact with the grip component and forming the second end of the hand tool, wherein the grip component is a reverse-molded component formed by:

forming the external portion of the grip component by molding a first thermoplastic elastomer (TPE) material or thermoplastic urethane (TPU) material into a shell that surrounds a first cavity, and after forming the external portion of the grip component, forming the inner portion of the grip component by injecting a second TPE material or TPU material into the first cavity, wherein the first TPE or TPU material has a first level of hardness, and the second TPE or TPU material has a second level of hardness lower than the first level of hardness, wherein the inner portion of the grip component is disposed around the shaft, wherein the external portion of the grip component forms the shell around the inner portion and forms an exposed user contact surface for the grip component, and wherein none of the second TPE or TPU material of the inner portion is exposed at a side of the grip component, and wherein the external portion and the inner portion of the grip component form a recessed portion of the grip component that fits around a portion of the endcap.

* * * * *